US011332302B2

(12) United States Patent
Tsubouchi et al.

(10) Patent No.: US 11,332,302 B2
(45) Date of Patent: May 17, 2022

(54) AEROSOL PRODUCT

(71) Applicant: Toyo Aerosol Industry Co., Ltd., Tokyo (JP)

(72) Inventors: Makoto Tsubouchi, Tokyo (JP); Ken Ogata, Tokyo (JP); Koichiro Watanabe, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 17/029,230

(22) Filed: Sep. 23, 2020

(65) Prior Publication Data

US 2021/0002064 A1 Jan. 7, 2021

Related U.S. Application Data

(63) Continuation of application No. PCT/JP2018/014683, filed on Apr. 6, 2018.

(51) Int. Cl.
*B65D 83/68* (2006.01)
*B65D 83/62* (2006.01)
*B65D 83/66* (2006.01)

(52) U.S. Cl.
CPC ..... *B65D 83/682* (2013.01); *B65D 83/62* (2013.01); *B65D 83/66* (2013.01)

(58) Field of Classification Search
CPC ..... B65D 83/62; B65D 83/68; B65D 83/682; B65D 83/66; B65D 83/28; B65D 83/20
(Continued)

(56) References Cited

U.S. PATENT DOCUMENTS 3,946,947 A * 3/1976 Schneider ..... A62C 5/002 239/401
4,219,159 A * 8/1980 Wesner ..... B05B 7/0062 239/343

(Continued)

FOREIGN PATENT DOCUMENTS

JP 2010-142689 A 7/2010
JP 2012-229318 A 11/2012

(Continued)

OTHER PUBLICATIONS

International Search Report dated May 15, 2018, issued in counterpart application No. PCT/JP2018/014683, w/English translation (4pages).

(Continued)

*Primary Examiner* — Charles P. Cheyney
(74) *Attorney, Agent, or Firm* — WHDA, LLP

(57) ABSTRACT

Provided is an aerosol product which has a simple configuration and enables spraying in the form of a mist at the time of use even when a stock liquid is stored in a high-viscosity state in an aerosol container. An aerosol product (100) has a plurality of partitioned housing spaces and a valve unit (120) provided with an inflow port (122) corresponding to the housing space, wherein at least one among the plurality of housing spaces is a main stock liquid housing section (142) that houses a main stock liquid (M), at least one other of the plurality of housing spaces is a viscosity lowering agent housing section (143) that houses a viscosity lowering agent (S), and the main stock liquid (M) discharged from the inflow port (122) and the viscosity lowering agent (S) discharged from the inflow port (122A) are mixed in an actuator (130).

2 Claims, 3 Drawing Sheets

(58) Field of Classification Search
USPC ..... 222/145.1–145.6, 190, 402.1, 394
See application file for complete search history.

(56) References Cited

U.S. PATENT DOCUMENTS

| | | | | |
|---|---|---|---|---|
| 4,768,717 | A * | 9/1988 | Shay | B05B 7/0056 239/403 |
| 5,275,763 | A * | 1/1994 | Fukai | A62C 5/02 169/15 |
| 5,611,490 | A * | 3/1997 | Barriac | B05B 7/0062 239/333 |
| 5,647,539 | A * | 7/1997 | Dobbs | B05B 7/0062 239/504 |
| 6,561,438 | B1 * | 5/2003 | Restive | B05B 7/005 239/310 |
| 6,736,288 | B1 | 5/2004 | Green | |
| 7,040,507 | B2 * | 5/2006 | Koike | A61K 8/046 222/94 |
| 7,059,546 | B2 * | 6/2006 | Ogata | B65D 83/752 239/524 |
| 2001/0027981 | A1 * | 10/2001 | Yquel | B65D 83/68 222/136 |
| 2004/0050956 | A1 | 3/2004 | Ogata et al. | |
| 2009/0108021 | A1 * | 4/2009 | Hansen | C12N 15/8247 222/1 |
| 2012/0091229 | A1 * | 4/2012 | Laidler | B05B 11/3059 239/330 |
| 2014/0008389 | A1 * | 1/2014 | Mekata | B65D 83/425 222/94 |
| 2014/0246515 | A1 * | 9/2014 | Nakajima | A61K 8/342 239/307 |
| 2014/0361037 | A1 * | 12/2014 | Green | B65D 83/48 222/94 |
| 2016/0128915 | A1 * | 5/2016 | Konno | A61Q 5/10 424/62 |
| 2016/0137394 | A1 * | 5/2016 | Sugawara | B65D 83/66 222/402.1 |
| 2018/0029781 | A1 * | 2/2018 | Nakajima | A61K 8/9789 |
| 2018/0162630 | A1 | 6/2018 | Shimizu | |
| 2019/0210792 | A1 * | 7/2019 | Tsubouchi | B65D 83/66 |

FOREIGN PATENT DOCUMENTS

| | | | |
|---|---|---|---|
| JP | 2013-79082 | A | 5/2013 |
| JP | 2014-129119 | A | 7/2014 |
| JP | 2016-117531 | A | 6/2016 |
| JP | 2016-222256 | A | 12/2016 |
| WO | 2012/007843 | A2 | 1/2012 |
| WO | 2017/026050 | A1 | 2/2017 |

OTHER PUBLICATIONS

Notification of Reason for Refusal, issued in counterpart Japanese Patent Application No. 2018-526954, w/English translation (4 pages).
Extended (Supplementary) European Search Report dated Mar. 10, 2021, issued in counterpart EP Application No. 18913686.4. (7 pages).

* cited by examiner

AEROSOL PRODUCT

TECHNICAL FIELD

The present invention relates to an aerosol product having a valve unit having a stem protruding from an aerosol container, and an actuator fitted to the stem, and more particularly to an aerosol product suitable for spraying the contents in the form of a mist and further discharging the sprayed mist in the form of a foam.

BACKGROUND ART

Aerosol products having a valve unit having a stem protruding from an aerosol container, and an actuator fitted to the stem are well known, and those which spray the contents of a container from an actuator in the form of a mist and in the form of a foam are also well known.

For example, Patent Literature 1 discloses a foam forming section (attachment 5 for formation of foam) for use in a pump container or an aerosol container that is provided with meshes 5*e* and 5*f* between cylindrical joint bushes 5*a*, 5*b*, and 5*c* and is attached from the back side to an outer peripheral surface on the distal end side of a main body portion (nozzle 3) fitted with a nozzle tip (nozzle tip 4) having a well-known mechanical break mechanism (spray spiral groove portion 4*b*) on a bottom surface portion.

The foam forming section (attachment 5 for formation of foam) is attached in a state where there is an outside air intake port (slit 5*d*) communicating with outside air between the distal end of the main body portion (nozzle 3) and the foam forming section, and liquid contents discharged from the pump container or the aerosol container is sprayed in the form of a mist by passing through the nozzle tip (nozzle tip 4), and flows into the foam forming section (attachment 5 for formation of foam).

At this time, the liquid contents sprayed in the form of a mist are stirred by colliding with the inner peripheral surface of the foam forming section (attachment 5 for formation of foam) and the meshes 5*e* and 5*f*, converted into foam-like contents in the form including air sucked in from the outside air intake port (slit 5*d*), and discharged in the form of a foam from the distal end of the foam forming section (attachment 5 for formation of foam)

This makes it possible to achieve foam release in various liquid content release mechanisms that do not have a foam generation function, including pump containers and aerosol containers.

CITATION LIST

Patent Literature

Patent Literature 1: Japanese Patent Application Publication No. 2010-142689

SUMMARY OF INVENTION

Technical Problem

However, there is still room for improvement in the aerosol product provided with the attachment for formation of foam disclosed in Patent Literature 1.

That is, in order to discharge the contents in the form of a foam by using the attachment for formation of foam disclosed in Patent Literature 1, it is necessary to reduce and adjust the viscosity of the contents to such an extent that mist-spraying can be performed in the actuator. With a stock liquid that must be kept in a high-viscosity state until immediately before use for reasons such as maintaining stability over time, it is difficult to spray the contents in the form of a mist, the contents and air cannot be sufficiently mixed, and discharge in the form of a form is impossible.

The present invention solves these problems, and it is an object thereof to provide an aerosol product which has a simple configuration and enables spraying in the form of a mist at the time of use even when a stock liquid is stored in a high-viscosity state in an aerosol container.

Solution to Problem

The aerosol product according to the present invention has a valve unit having a stem protruding from an aerosol container, and an actuator fitted to the stem, wherein the aerosol container includes a plurality of partitioned housing spaces, an inflow port corresponding to the housing space, and one or more valve units in which a sealing member opening and closing the inflow port is provided for each inflow port; at least one among the plurality of housing spaces is a main stock liquid housing section that houses a main stock liquid; at least one other of the plurality of housing spaces is a viscosity lowering agent housing section that houses a viscosity lowering agent for lowering a viscosity of the main stock liquid; and the main stock liquid discharged from the inflow port corresponding to the main stock liquid housing section and the viscosity lowering agent discharged from the inflow port corresponding to the viscosity lowering agent housing section are mixed in the actuator, thereby resolving the aforementioned problem.

Advantageous Effects of Invention

According to the aerosol product of the invention according to claim 1, the aerosol container includes a plurality of partitioned housing spaces, an inflow port corresponding to the housing space, and one or more valve units in which a sealing member opening and closing the inflow port is provided for each inflow port; at least one among the plurality of housing spaces is a main stock liquid housing section that houses a main stock liquid; at least one other of the plurality of housing spaces is a viscosity lowering agent housing section that houses a viscosity lowering agent for lowering a viscosity of the main stock liquid; and the main stock liquid discharged from the inflow port corresponding to the main stock liquid housing section and the viscosity lowering agent discharged from the inflow port corresponding to the viscosity lowering agent housing section are mixed in the actuator. Therefore, even if the main stock liquid has a high viscosity, by mixing with the viscosity lowering agent in the actuator, the viscosity of the main stock liquid can be reduced to the extent enabling spraying in the form of a mist.

This makes it possible to perform mist-spraying of a main stock liquid that needs to be stored in a high-viscosity state in the aerosol container.

Further, even if the main stock liquid and the viscosity lowering agent react with each other and deteriorate when mixed together, they can be stored in a state of insulation from each other until immediately before use.

According to the configuration set forth in claim 2, the aerosol container has one can-shaped container and one or more deformable contents housing sections housed in the can-shaped container; and a propellant is housed in a space outside the contents housing section. Therefore, the pressure by the propellant is always uniformly applied to all the contents housing sections housed in the one can-shaped container, without having to individually adjust the pressure for each housing section.

According to the configuration set forth in claim 3, the actuator has a fitting portion fitted to the stem, a mixing unit where materials discharged from the inflow ports are mixed, and a mist-spraying mechanism unit for spraying the mixed discharged materials in the form of a mist. Therefore, the discharged materials can be sprayed in the form of a mist.

Further, even if the residual liquid of the main stock liquid and the viscosity lowering agent mixed in the actuator is fixedly attached therein, satisfactory spraying in the form of a mist can be maintained by simply replacing with a new actuator or washing the actuator.

Further, the state of the mist to be sprayed can be changed by replacing with an actuator of a different shape.

According to the configuration set forth in claim 4, the actuator further includes a foam forming section that foams, while entraining air, the discharged materials sprayed from the mist-spraying mechanism unit. Therefore, the discharged materials can be discharged in the form of a foam.

Further, even if the residual liquid of the main stock liquid and the viscosity lowering agent mixed in the actuator is fixedly attached therein, satisfactory discharge in the form of a foam can be maintained by simply replacing with a new actuator or washing the actuator.

Further, the state of the foam to be discharged can be changed by replacing with an actuator of a different shape.

REFERENCE SIGNS LIST

Figure 1:
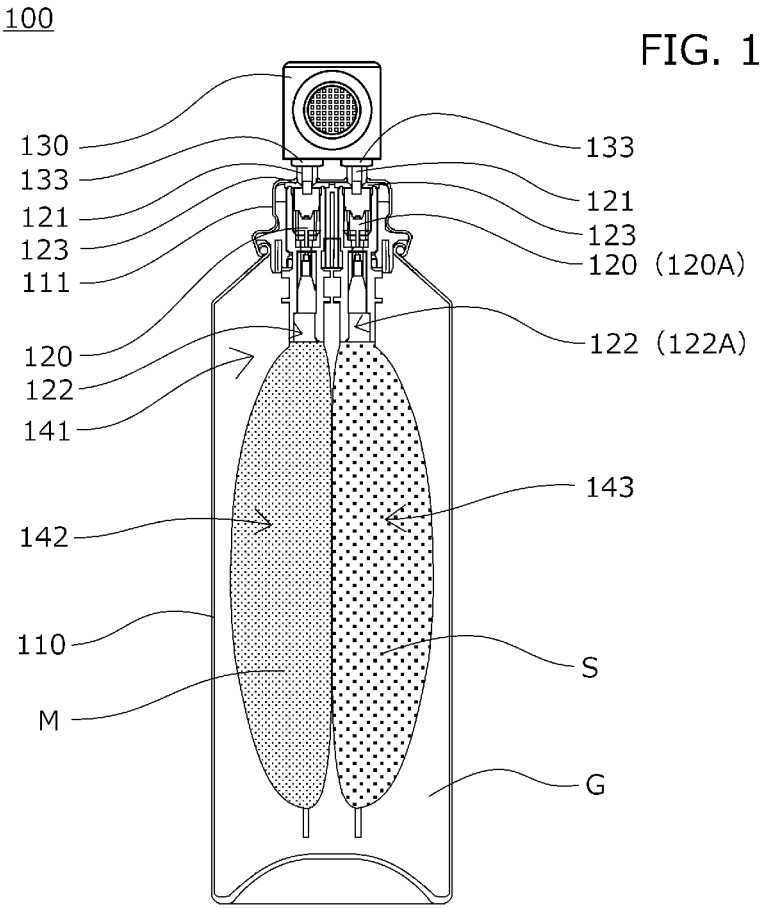
FIG. 1 is a cross-sectional view of an aerosol product 100 according to one embodiment of the present invention.

100 Aerosol product
110 Aerosol container
111 Mounting cup
120 Valve unit
120A Viscosity lowering agent valve unit
121 Stem
122 Inflow port
122A Viscosity lowering agent inflow port
123 Sealing portion
130 Actuator
131 Main body portion
132 Foam forming section
133 Fitting portion
134 Discharge flow path
135 Mixing section
136 Nozzle tip
137 Outside air intake port
138 Entraining space
139 Discharge port
140 Mesh
141 Propellant housing section
142 Main stock liquid housing section
143 Viscosity lowering agent housing section
G Propellant
M Main stock liquid
S Viscosity lowering agent

DESCRIPTION OF EMBODIMENTS

Hereinafter, an aerosol product 100 according to an embodiment of the present invention will be described with reference to the drawings.

As shown in FIG. 1, the aerosol product 100 is a so-called dual valve type product in which two valve units 120 are fixed to the mouth of an aerosol container 110 with a mounting cup 111 and two stems 121 project upward.

A bag-shaped main stock liquid housing section 142 and a viscosity lowering agent housing section 143 are provided in the housing space in the aerosol container 110, a propellant housing section 141 is further provided outside the main stock liquid housing section 142 and outside the viscosity lowering agent housing section 143, and the inside of the aerosol container 110 is partitioned into three housing spaces.

A main stock liquid M is tightly housed in the main stock liquid housing section 142, and a viscosity lowering agent S, which has a lower viscosity than the main stock liquid M, is tightly housed in the viscosity lowering agent housing section 143.

A propellant G for applying pressure to the main stock liquid housing section 142 and the viscosity lowering agent housing section 143 is housed in the propellant housing section 141.

An inflow port 122 communicating between the inside and the outside of the valve unit 120 is provided at the lower part of the valve unit 120, one of the two valve units 120 is connected to the inflow port 122 so that the main stock liquid M inside the main stock liquid housing section 142 is discharged therein, and the other valve unit 120A (hereinafter, referred to as "viscosity lowering agent valve unit 120A") is connected to an inflow port 122A (hereinafter, referred to as "viscosity lowering agent inflow port 122A") so that the viscosity lowering agent S inside the viscosity lowering agent housing section 143 is discharged therein.

Figure 2:
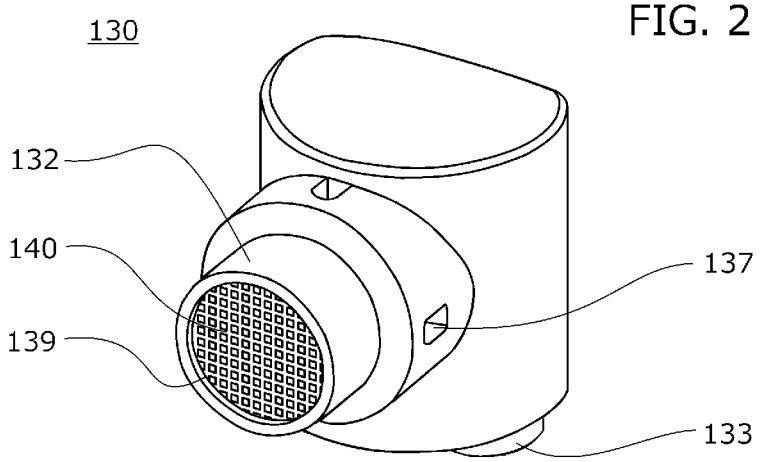
FIG. 2 is a perspective view of an actuator 130 according to one embodiment of the present invention.
Figure 3:
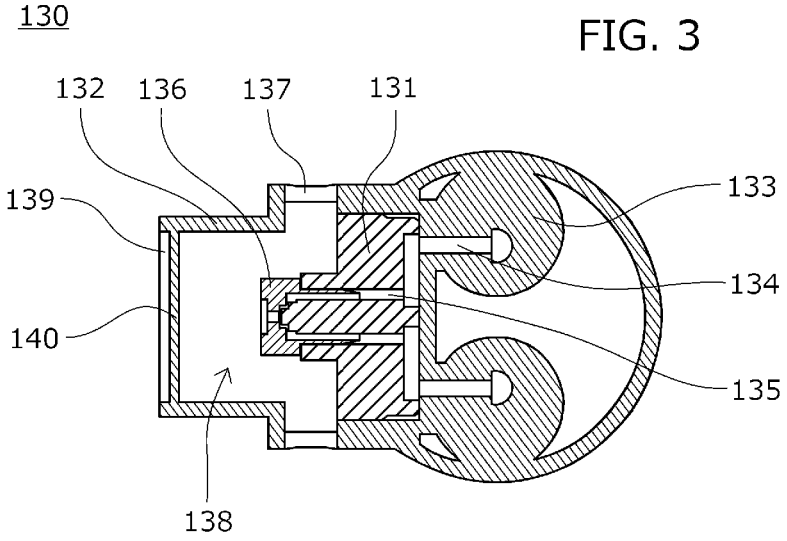
FIG. 3 is a top cross-sectional view of the actuator 130 according to one embodiment of the present invention.
Figure 4:
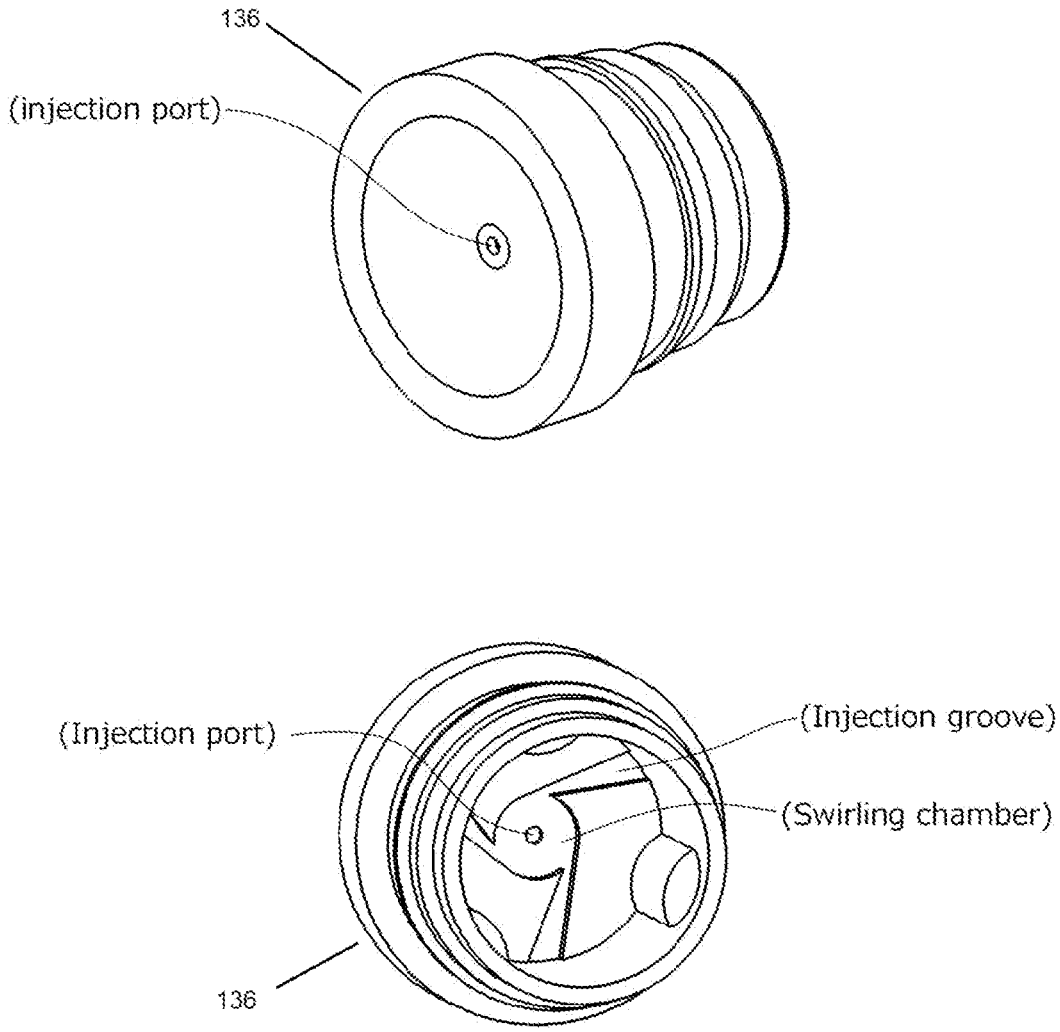
FIG. 4 is a mist-spraying mechanism unit according to one embodiment of the present invention.

An actuator 130 is attached, through a fitting portion 133, to the stems 121 projecting upward from the two valve units 120. As shown in FIGS. 2 and 3, a discharge flow path 134 provided in the main body portion 131 in the actuator 130 communicates the two stems 121, and after the main stock liquid M and the viscosity lowering agent S have been merged in the mixing section 135, the mixture is sprayed in the form of a mist into an entraining space 138 in the foam forming section 132 having an outside air intake port 137 through the nozzle tip 136 having a mist-spraying mechanism unit, as shown in FIG. 4, the air is entrained to form the foam, and the foam can be discharged from a discharge port 139 through a mesh 140.

Described hereinbelow is how the main stock liquid M and the viscosity lowering agent S are discharged in the form of a foam by the aerosol product 100.

First, by pressing the actuator 130 downward, the blockage of the inflow port 122, the viscosity lowering agent inflow port 122A, and the flow path in the stems 121 by the sealing portion 123 is released, the valve unit 120 and the viscosity lowering agent valve unit 120A are opened, the propellant G housed in the propellant housing section 141 applies pressure to the main stock liquid housing section 142 and the viscosity lowering agent housing section 143, and the main stock liquid M and the viscosity lowering agent S are discharged from the stems 121.

At this time, the pressure by the propellant G housed in the propellant housing section 141 in the aerosol container 110 is always uniformly applied to the main stock liquid housing section 142 and the viscosity lowering agent housing section 143 from the start of use until the end of use, without having to individually adjust the pressure for each housing section.

As the propellant G, a liquefied gas or a compressed gas can be used.

Where the propellant G is formed of a liquefied gas, even if the pressure of the gas-phase portion of the propellant G is reduced as a result of discharging the main stock liquid M and the viscosity lowering agent S, the liquid-phase portion of the propellant G is vaporized to compensate the pressure of the propellant G, so that a decrease in the discharge pressure of the main stock liquid M and the viscosity lowering agent S can be prevented.

Further, when the propellant G is composed of a compressed gas, a sharp increase in pressure can be suppressed even in a high temperature state, as compared with the case where a liquefied gas is used as the propellant G.

Here, known liquefied gas and compressed gas which are generally used for aerosol products can be used as the types of gas to be used as the propellant G.

The types of liquefied gas to be used as the propellant G can be exemplified by propane, butane, pentane, or a liquefied petroleum gas including these, dimethylether, hydrofluoroolefins, hydrofluorocarbons, and the like, and the types of compressed gas to be used as the propellant G can be exemplified by nitrogen, carbondioxide, compressed air, oxygen, helium, nitrousoxide, and the like, and a mixture of a plurality of these types may be used.

The main stock liquid M and the viscosity lowering agent S pass through the discharge flow path 134 of the main body portion 131, merge in the mixing section 135, and proceed to the nozzle tip 136 side having the mist-spraying mechanism unit.

At this time, the main stock liquid M and the viscosity lowering agent S are mixed by violently colliding in the mixing section 135 (hereinafter, a product obtained by mixing the main stock liquid M and the viscosity lowering agent S is referred to as a mixture).

Even when the viscosity of the main stock liquid M is high, the viscosity of the mixture is reduced by mixing and diluting with the viscosity lowering agent S to such an extent that spraying in the form of a mist is possible. Therefore, where the mixture passes through the nozzle tip 136 having the mist-spraying mechanism unit, the mixture is sprayed into the entraining space 138 in the form of a mist.

The pressure inside the entraining space 138 is reduced by the force of the mixture sprayed into the entraining space 138, and the air outside the actuator 130 flows into the entraining space 138 from the outside air intake port 137.

Here, the mixture sprayed in the form of a mist from the nozzle tip 136 having the mist- spraying mechanism unit is sprayed in the form of a mist into the entraining space 138 while being mixed with the air flowing in from the outside air intake port 137, collides against the inner wall, and further passes through the mesh 140, whereby air-containing foam is formed and discharged from the discharge port 139 in the form of a foam.

As a result, even the main stock liquid M which needs to be stored in a high-viscosity state in the aerosol container 110 can be discharged in the form of a foam.

Further, even if the main stock liquid M and the viscosity lowering agent S react with each other and deteriorate when mixed together, they can be stored in a state of insulation from each other until immediately before use.

Further, since a foaming mechanism is provided in the actuator 130, even if the residual liquid of the mixture mixed in the actuator 130 is fixedly attached therein, satisfactory discharge in the form of a foam can be maintained by simply replacing the actuator 130 with a new actuator or washing the actuator 130.

Further, the state of the foam to be discharged can be changed by replacing the actuator 130 with an actuator of a different shape.

The embodiments of the present invention have been described hereinabove in detail. However, the present invention is not limited to the above embodiments, and various design changes can be made without departing from the present invention set forth in the claims.

In the above-described embodiments, the so-called dual valve type in which one aerosol container has two valve units has been described. However, the configuration of the present invention is not limited to this. For example, the number of valve units may be three or more, a configuration may be used in which a plurality of aerosol containers having one valve unit and one or more housing spaces are connected, and one valve unit may be provided with a plurality of inflow ports and sealing portions corresponding to respective inflow ports.

Further, in the above-described embodiments, the configuration is described in which the bag-shaped main stock liquid housing section and the viscosity lowering agent housing section are provided in the housing space in the aerosol container, the propellant housing section is further provided outside the main stock liquid housing section and outside the viscosity lowering agent housing section, and the inside of the aerosol container is partitioned into three housing spaces. However, this configuration inside the aerosol container is not limiting, and for example, a configuration may be used in which the inside of the aerosol container is partitioned into two housing spaces, namely, a bag-shaped main stock liquid housing section and a propellant housing section outside the main stock liquid housing section, a propellant and a viscosity lowering agent are together placed in the propellant housing section, and only the viscosity lowering agent can be sucked in to flow into the valve unit.

Further, in the above-described embodiments, the description has been given assuming that the viscosity lowering agent valve unit discharges the viscosity lowering agent, but this material to be discharged from the viscosity lowering agent valve unit is not limiting, and a secondary agent to be reacted with the main stock liquid may be mixed with the viscosity lowering agent immediately before use.

Further, in the above-described embodiments, the configuration is described in which the main stock liquid is diluted with the viscosity lowering agent having a viscosity lower than that of the main stock liquid so as to obtain the viscosity that enables spraying in the form of a mist, but the method for lowering the viscosity of the main stock liquid with the viscosity lowering agent is not limiting. For example, a viscosity lowering agent that has a higher viscosity than the main stock liquid and can lower the viscosity of the main stock liquid by a chemical reaction may be used.

Further, in the above-described embodiments, the configuration is described in which the mixture is passed through the nozzle tip having the mist-spraying mechanism unit, thereby spraying in the form of a mist in the foam forming section, but this method for spraying in the form of a mist is not limiting. For example, spraying in the form of a mist may be performed by passing through a mechanical break up portion, or spraying in the form of a mist may be performed using another method without providing a mechanical break up portion.

In the above-described embodiment, the mist-spraying mechanism unit is described as being provided in the nozzle tip. However, this location of the mist-spraying mechanism unit is not limiting, and the mist-spraying mechanism unit may be provided in, for example, the main body portion or the mixing section. Alternatively, a plurality of mist-spraying mechanism units may be prepared and arranged at a plurality of locations in the actuator.

Further, in the above-described embodiment, the configuration is described in which the mixture sprayed in the form of a mist from the nozzle tip having the mist-spraying mechanism unit is sprayed in the form of a mist into the entraining space while being mixed with the air flowing in from the outside air intake port, collides against the inner wall, and further passes through the mesh, whereby air-containing foam is formed and discharged from the discharge port in the form of a foam. However, this method for discharging in the form of a foam is not limiting. For example, the mist-sprayed mixture may pass through the mesh to form a foam without colliding with the inner wall, or may be caused to collide with the outside of the actuator to form a foam without providing the mesh.

The invention claimed is:

1. An aerosol product having a valve unit having a stem protruding from an aerosol container, and an actuator fitted to the stem, wherein the aerosol container includes a plurality of partitioned housing spaces, an inflow port corresponding to the housing space, and one or more valve units in which a sealing member opening and closing the inflow port is provided for each inflow port;

at least one among the plurality of housing spaces is a main stock liquid housing section that houses a main stock liquid;

at least one other of the plurality of housing spaces is a viscosity lowering agent housing section that houses a viscosity lowering agent for lowering a viscosity of the main stock liquid;

the actuator has a fitting portion fitted to the stem, and a mixing unit where materials discharged from the inflow port are mixed;

the main stock liquid discharged from the inflow port corresponding to the main stock liquid housing section and the viscosity lowering agent discharged from the inflow port corresponding to the viscosity lowering agent housing section are mixed in the mixing unit and a viscosity of the main stock liquid is lowered in the actuator;

the actuator has a mist-spraying mechanism unit that sprays the mixed discharged materials into an entraining space in the form of a mist through a nozzle tip having the mist-spraying mechanism unit, and air outside the actuator flows into the entraining space for reducing a pressure inside the entraining space;

the actuator further includes a foam forming section that foams, while entraining air, the discharged materials sprayed from the mist-spraying mechanism unit;

a discharge flow path provided in a main body portion of the actuator communicates with the stem;

the main stock liquid and the viscosity lower agent pass through the discharge flow path of the main body portion, merge in the mixing unit, and proceed to the nozzle tip; and the main body portion of the actuator is connected to and received within the fitting portion.

2. The aerosol product according to claim 1, wherein the aerosol container has one can-shaped container and one or more deformable contents housing sections housed in the can-shaped container; and a propellant is housed in a space outside the contents housing section.

* * * * *